US007081042B2

(12) United States Patent
Chen et al.

(10) Patent No.: US 7,081,042 B2
(45) Date of Patent: Jul. 25, 2006

(54) SUBSTRATE REMOVAL FROM POLISHING TOOL

(75) Inventors: Hung Chih Chen, Santa Clara, CA (US); Steven M. Zuniga, Soquel, CA (US); Tsz-Sin Siu, Lai Chi Kok (HK)

(73) Assignee: Applied Materials, Santa Clara, CA (US)

( * ) Notice: Subject to any disclaimer, the term of this patent is extended or adjusted under 35 U.S.C. 154(b) by 0 days.

(21) Appl. No.: 11/004,223

(22) Filed: Dec. 2, 2004

(65) Prior Publication Data

US 2006/0019582 A1 Jan. 26, 2006

Related U.S. Application Data

(60) Provisional application No. 60/590,451, filed on Jul. 22, 2004.

(51) Int. Cl.
*B24B 1/00* (2006.01)

(52) U.S. Cl. ..... 451/41; 451/388

(58) Field of Classification Search ..... 451/41, 451/285–289, 388
See application file for complete search history.

(56) References Cited

U.S. PATENT DOCUMENTS

| | | | | |
|---|---|---|---|---|
| 5,899,801 | A * | 5/1999 | Tolles et al. | 451/288 |
| 5,964,653 | A | 10/1999 | Perlov et al. | |
| 6,132,294 | A * | 10/2000 | Lin | 451/41 |
| 6,159,079 | A * | 12/2000 | Zuniga et al. | 451/41 |
| 6,183,354 | B1 | 2/2001 | Zuniga et al. | |
| 6,305,677 | B1 | 10/2001 | Lenz | |
| 6,422,927 | B1 | 7/2002 | Zuniga | |
| 6,450,868 | B1 | 9/2002 | Zuniga et al. | |
| 6,558,228 | B1 * | 5/2003 | Cheng et al. | 451/7 |
| 6,857,945 | B1 | 2/2005 | Chen et al. | |
| 2003/0079691 | A1 * | 5/2003 | Shang et al. | 118/729 |

OTHER PUBLICATIONS

U.S. Appl. No. 10/810,784, filed Mar. 26, 2004, Chen et al., 17 pages.

* cited by examiner

*Primary Examiner*—Dung Van Nguyen
(74) *Attorney, Agent, or Firm*—Fish & Richardson

(57) ABSTRACT

Techniques for removing a substrate from a polishing pad are described. A substrate is pulled away from the polishing pad such that the edges of the substrate are pulled away from the polishing pad before the center of the substrate is pulled from the polishing pad.

21 Claims, 3 Drawing Sheets

SUBSTRATE REMOVAL FROM POLISHING TOOL

CROSS-REFERENCE TO RELATED APPLICATIONS

This application claims the benefit of U.S. Provisional Application No. 60/590,451, filed on Jul. 22, 2004, which is incorporated by reference herein.

BACKGROUND

This invention relates to transport of a substrate by a carrier in a semiconductor fabrication tool.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating disk-shaped polishing pad or a linearly advancing belt-shaped polishing pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing liquid, such as a slurry including abrasive particles, is supplied to the surface of the polishing pad.

SUMMARY

In general, the invention provides techniques for removing a substrate from a polishing pad after the substrate has been polished. Removing the substrate from the polishing pad is sometimes called "substrate dechuck".

In general, in one aspect, the invention features methods of dechucking a substrate from a surface. One such method can include applying a first pressure to a central portion of a first side of a substrate, wherein a second side of the substrate is in contact with a polishing surface. A second pressure is applied to the first side at an outer portion of the first side of the substrate, wherein the second pressure generates a force on the substrate away from the polishing surface. Applying the first and second pressures causes the substrate to move away from the polishing surface.

Applying pressure at the center of the substrate can create a force that is toward the polishing pad. Applying pressure at a perimeter of the substrate can create a force that is away from the polishing pad. Applying a pressure at an edge of the substrate can create a force toward the polishing pad, where the pressure seals the membrane to the substrate. Fluid can either be introduced or evacuated from chambers adjacent to the substrate in order to affect the pressures. Applying the first and second pressures causes the edge of the substrate to lift away from the polishing pad before the center of the substrate is lifted from the polishing pad.

Implementations of this invention may include one or more of the following advantages. The likelihood of successfully lifting the substrate from the polishing pad may be less dependent on the surface characteristics of the polishing pad, such as the pad condition, e.g., the amount of glazing or compression of the polishing pad, or the pad topography. Similarly, the process steps needed to remove the substrate from the polishing pad may be less dependent on the condition of the polishing pad, e.g., removing a substrate from a compressed pad may not require more force than removing a substrate from an uncompressed pad. The suction between the substrate and the polishing pad that might otherwise be created if the carrier head applies an upward force to the center of the substrate can be reduced or eliminated. Consequently, the substrate dechuck process can be faster, be smoother, cause less stress on the substrate and be less likely to damage the substrate. Less force may be required to pull the substrate from the polishing pad and the substrate may be subjected to a bending force for a shorter duration. For example, the substrate can be removed from the polishing pad by applying as little as five pounds of force across the area of a 300 mm wafer, instead of the one-hundred pounds that can be required with a center lift method. Because less force is applied to the substrate and the substrate spends less time in a non-flat condition, the likelihood of defects or damage (including substrate breakage) in the substrate can be reduced.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
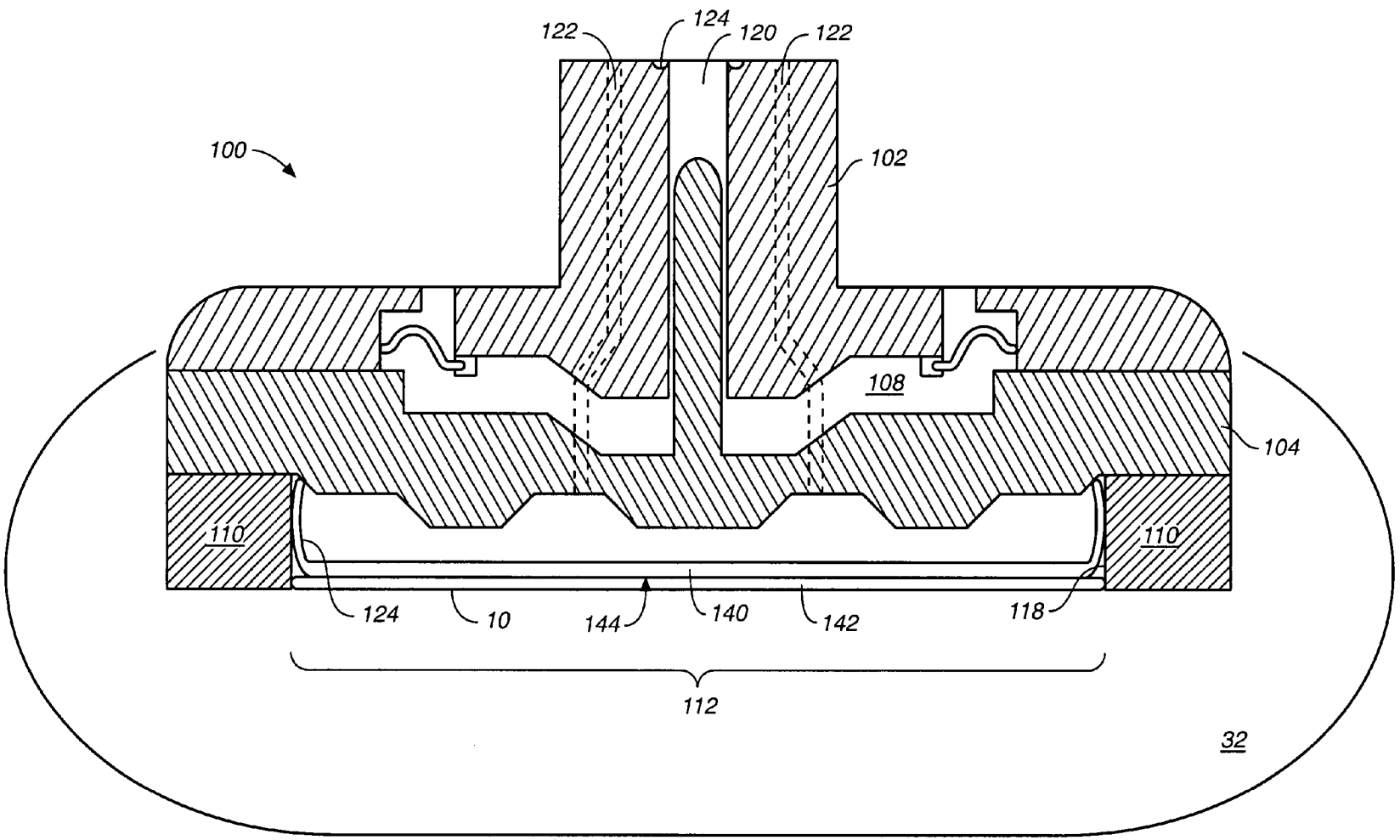
FIG. 1A shows a schematic of a substrate carrier head.

As shown in FIG. 1A, an exemplary carrier head 100 includes a housing 102, a base assembly 104, a loading chamber 108, a retaining ring 110, and a substrate backing assembly 112 which includes two or more pressurizable chambers. A description of a similar carrier head may be found in U.S. Pat. No. 6,183,354, U.S. patent application Ser. No. 09/712,389, filed Nov. 13, 2000, and U.S. patent application Ser. No. 10/810,784, filed Mar. 26, 2004, the entire disclosure of which is incorporated herein by reference.

The housing 102 can be generally circular in shape and can be connected to the drive shaft to rotate therewith during polishing. A vertical bore 120 can be formed through the housing 102, and five additional passages 122 (only two passages are illustrated) can extend through the housing 102 for pneumatic control of the carrier head. O-rings 124 can be used to form fluid-tight seals between the passages through the housing and passages through the drive shaft.

The loading chamber 108 is located between the housing 102 and the base assembly 104 to apply a load, i.e., a downward pressure or weight, to the base assembly 104. The vertical position of the base assembly 104 relative to the polishing pad 32 is also controlled by the loading chamber 108.

The retaining ring 110 can be a generally annular ring secured at the outer edge of the base assembly 104. When fluid is pumped into the loading chamber 108 and the base assembly 104 is pushed downwardly, the retaining ring 110 is also pushed downwardly to apply a load to the polishing pad 32. An inner surface 118 of the retaining ring 110 engages the substrate to prevent it from escaping from beneath the carrier head.

The substrate backing assembly 112 includes a flexible membrane 140. The flexible membrane 140 is formed of a flexible and elastic fluid-impermeable material, such as neoprene, chloroprene, ethylene propylene rubber or silicone. For example, the flexible membrane 140 can be formed of either compression molded silicone or liquid injection molded silicone. The membrane 140 should be hydrophobic, durable, and chemically inert vis-à-vis the polishing process.

The flexible membrane 140 includes a generally flat main portion 142. A lower surface 144 of the main portion 142 provides a mounting surface for the substrate 10. The membrane 140 can also include an annular perimeter portion 124 that extends away from the polishing surface for connection to the base.

The flexible membrane 140 can be divided into separate areas, such as annular concentric portions. In one implementation, the concentric annular portions are created by forming chambers between the membrane 140 and the carrier head base assembly 104. The annular chambers can be created in one of various ways, such as with a second membrane, as described in U.S. Pat. No. 6,450,868, which is incorporated herein by reference, or by selecting a membrane with portions that extend from an upper surface of the membrane and connect to the carrier head such that the individual chambers formed between the extending portions are separated from one another. An example of such a portion that extends from the upper surface of the membrane is a flap, as described below. The mechanism for separating the annular chambers permits the volume in each chamber to be independently pressurizable.

Figure 1B:
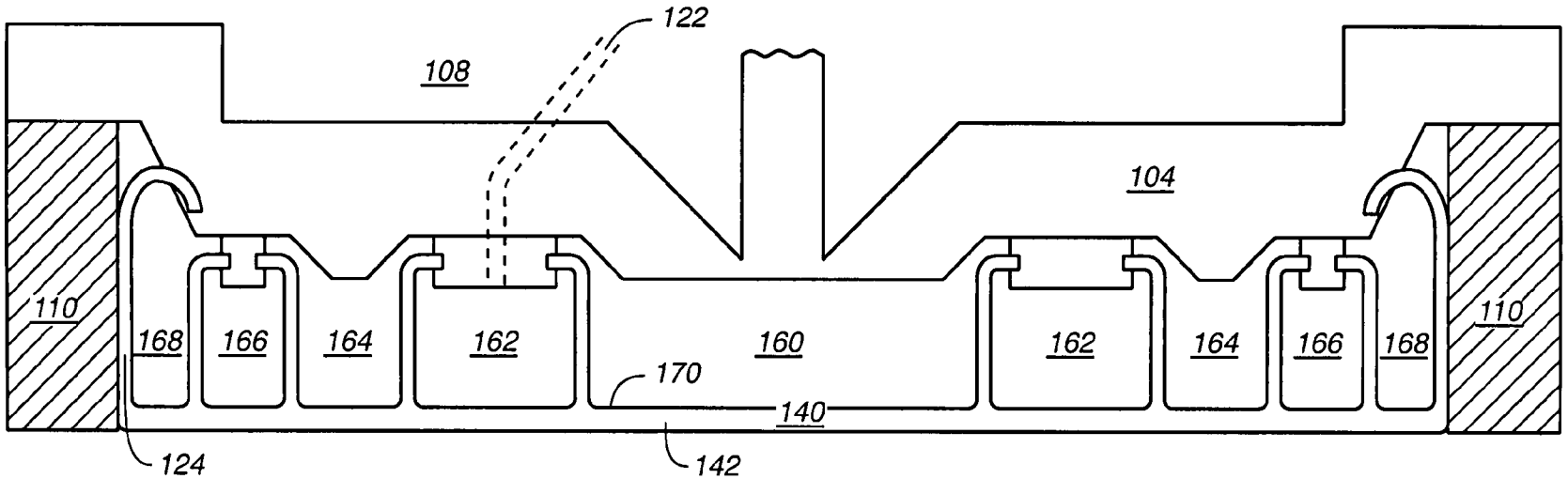
FIG. 1B shows a membrane with chambers behind the membrane.

As shown in FIG. 1B, one or more concentric annular inner flaps extend from the inner surface 170 of the main portion 142 and are connected to the base 104 to divide the volume between the membrane and the base into the independently pressurizable chambers. The ends of the flaps can be secured to the base by an annular clamp ring (which can be considered part of the base). The end of the perimeter portion 124 can also be secured to the base assembly 104 by annular clamp ring (which also can be considered part of the base), or the end of the perimeter portion 124 can be clamped between the retaining ring 110 and the base 104.

In a carrier head with five pressurizable chambers, a central pressurizeable chamber 160 can be centrally located and an edge pressurizeable chamber 168 can be located approximately at the perimeter of the back side of the flexible membrane 140. Concentric pressurizeable second 162, third 164 and fourth chambers 166 can be located between the central chamber 160 and the edge chamber 168. Each chamber is associated with a portion of the membrane 140 that is proximate to the chamber thereby defining central, second, third, fourth and perimeter portions of the membrane 140.

Each chamber can be fluidly coupled by passages through the base assembly 104 and housing 102 to an associated pressure source, such as a pump or pressure or vacuum line. For example, one or more passages 122 in the base assembly 104 can be linked to passages in the housing by flexible tubing that extends inside the loading chamber 108 or outside the carrier head 100. Directing fluid into or evacuating fluid from that chamber controls the pressure in each chamber, and the load applied by the associated segment of the flexible membrane 140 on the substrate 10. Thus, the load applied to the different radial regions on the substrate can be independently controlled. This permits different forces to be applied to different radial regions of the substrate 10.

The substrate is transferred to a polishing station and brought in contact with a polishing pad for polishing. During polishing, a polishing slurry is generally provided that has desirable polishing characteristics, such as, for example, being abrasive, non-abrasive, chemically reactive or selective to particular materials. In general, polishing slurries have a wetting characteristic.

Once polishing is completed at one polishing station, the substrate is transferred from the polishing station to the next stage of the manufacturing process. The next stage might be at another polishing station in the CMP apparatus, at a different type of station, e.g., an electrodeposition station, in the apparatus or at a different apparatus. When the substrate is transferred, the substrate is dechucked from the polishing pad of the polishing station. Substrate dechuck can be performed by creating a low pressure pocket behind the carrier head's membrane in a chamber that is proximate to a central portion of the membrane.

Figure 2:
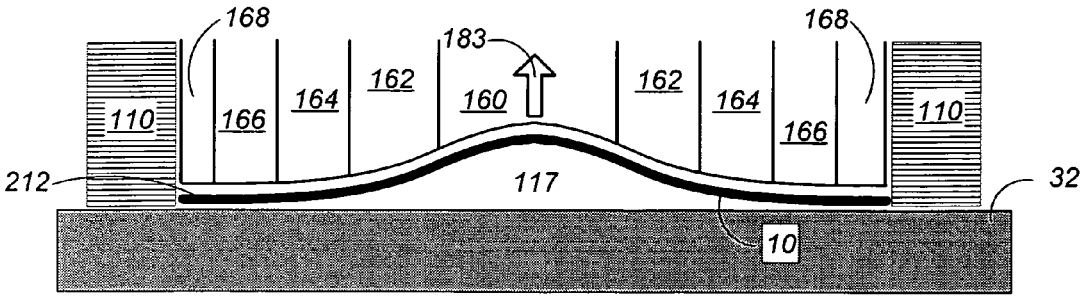
FIG. 2 shows a representation of a substrate being lifted from a polishing pad using a center lift dechuck method.

As shown in FIG. 2, in a conventional CMP system, a substrate is dechucked from the polishing pad 32 by applying an upward force 183 to the center of substrate 10 to pull the substrate 10 from polishing pad 32. The upward force 183 can be applied by evacuating fluid from the central chamber 160 behind the membrane 140, resulting in the membrane 140 bowing inwardly and lifting the center of the substrate 10 along with the membrane 140. The force applied to the center of the substrate 10 can cause the substrate 10 to form a suction cup shape with a low pressure pocket 117 between the substrate 10 and the polishing pad 32. The edge of the substrate 212 tends to adhere to the polishing pad 32 due to the wetting characteristic of the slurry. The edge 212 adhering to the polishing pad 32 in combination with the low pressure pocket 117 contributes to the amount of force required to pull the substrate 10 away from the polishing pad 32. When sufficient force is applied to cause a portion of the substrate's edge 212 to pull from the polishing pad 32, air enters the low pressure pocket 117. Air entering the low pressure pocket 117 releases the distorting pressure on the substrate 10 and the substrate 10 returns to its flat shape. The force that is generally required to pull a substrate 10, such as a 300 mm substrate, from a polishing pad 32 using the center lift technique can be around one-hundred pounds across the surface of the wafer.

As an alternative to the conventional method of dechucking, the upward force can be moved toward the perimeter of the substrate while a downward force is applied to the center of the substrate. Using this method of substrate dechuck causes the substrate to deform into a bowl-like shape and allows air to enter between the substrate and the polishing pad during dechuck, eliminating the suction cup effect.

Figure 3:
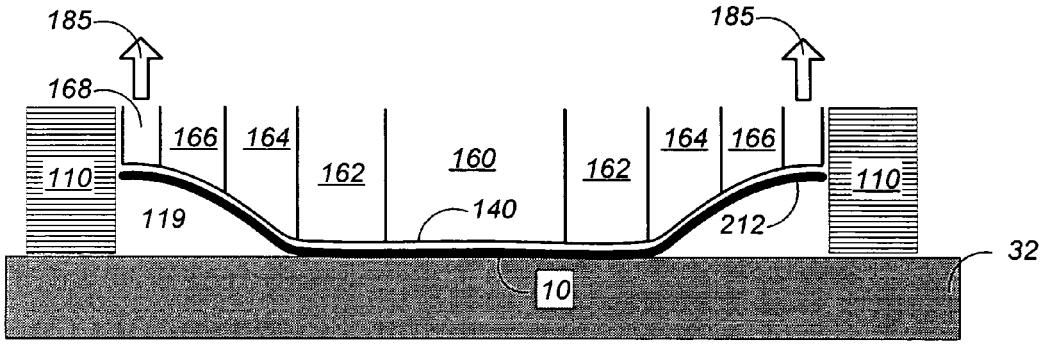
FIG. 3 shows a representation of a substrate lifted from a polishing pad using an edge lift dechuck method.

As shown in FIG. 3, in one implementation, an upward force 185 is applied to the edges 212 of the substrate 10 to pull the substrate from the polishing pad 32. The edge chamber 168 can be evacuated of fluid, creating a low-pressure area behind the substrate's edge 212 and pulling the substrate's edge 212 in an upward direction. This technique can be used when the substrate adheres to the membrane more strongly than to the pad, which will depend on the composition of the pad, substrate, membrane and polishing environment, such as the slurry composition. Assuming the substrate adheres to the membrane, then air can enter the space 119 between the substrate 10 and the polishing pad 32 when the substrate 10 is pulled from the polishing pad 32 at the edges. Using this edge-lift technique, the amount of lift required to pull the substrate's edge 212 can be less than one-hundred pounds, such as, for example, less than twenty pounds, less than ten pounds, or around five pounds. In one implementation, a slight downward force, such as about one or two psi, is applied to the central portion of the substrate 10. Alternatively, the central portion can be vented to the atmosphere.

In some instances, the substrate adheres to the polishing pad more strongly than to the membrane when the edge of the membrane is lifted. In this case, the substrate remains on the polishing pad 32 and releases from the membrane. Air enters the space between the membrane 140 and the substrate 10, allowing the membrane 140 to pull away from the substrate 10.

A technique to compensate for this problem is to apply a downward force to the edge of the substrate 10 so as to seal the edge of the substrate against the membrane, and apply an upward force to an area just inside of the edge of the substrate 10. Moreover, if a downward force is applied to the center of the substrate 10, the suction cup shape is not formed, as in the conventional method of dechuck.

Figure 4:
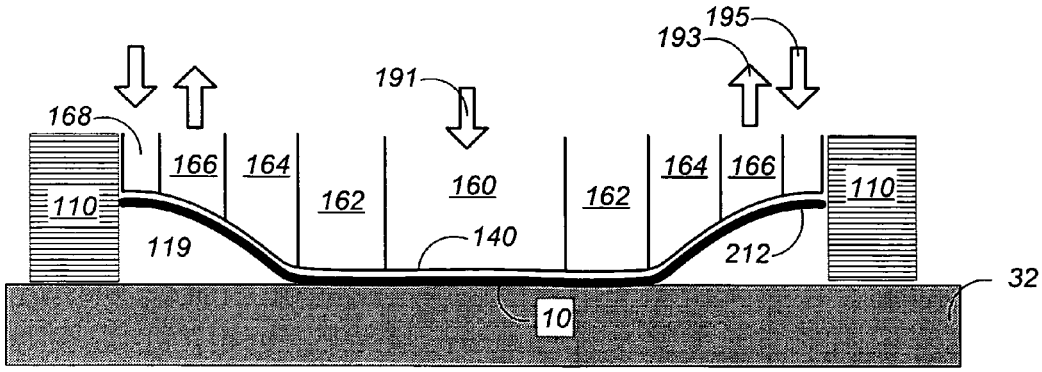
FIG. 4 shows a representation of a substrate being lifted from a polishing pad using a modified edge lift dechuck method.

As shown in FIG. 4, in one embodiment, a downward force is applied at the outer portion of the membrane, an upward force is applied to a chamber between the outer portion and the center of the substrate, such as at the second 162, third 164 or fourth chamber 166, and a downward force 191 is applied at the central chamber 160. To apply the downward force 191, the central chamber 160 can be vented to the atmosphere or a fluid can be directed into the central chamber 160. The downward force 191 need not be a great force, e.g., about zero to about two psi. The downward force 191 only need be a force that causes the upward force to pull up on the substrate in comparison to the downward force 191.

The chamber between the central chamber 160 and the edge chamber 168, can be evacuated to form a low-pressure area. The low-pressure area creates an upward force 193 on the substrate 10. Any chamber that is not involved in producing an upward or downward force can be vented to the atmosphere. Fluid is directed into the edge chamber 168 such that a slight downward force 195 is placed on the substrate's edge 212. The upward force in the fourth chamber 166 pulls up on the substrate 10 while the pressure applied to the edge of substrate 10 seals the edge of substrate 10 to the membrane 140.

In one implementation, the seal at the edge is formed at the outer two to three millimeters of the substrate. The central downward pressure is adjacent to the center of the substrate and extends to about the twenty to thirty millimeters from the edge of the substrate. The low-pressure area is between the central downward pressure and the outer edge.

In one implementation, the pressure that is applied to the edge of the substrate during dechuck are between about zero and three psi gauge pressure. In one implementation, the pressure that is applied at the low-pressure area is four psi gauge pressure, or between about eight and twelve psi absolute. In one implementation, the pressure applied to the center of the substrate is between zero and three psi gauge. Other appropriate pressures can also be used to dechuck the substrate so long as the pressure applied at the center portion of the substrate is a downward pressure relative to a pressure applied just outside of the center portion of the substrate.

One element that typically can affect the ease of substrate dechuck from the polishing pad is the surface texture of the polishing pad. For example, grooves or surface topography in the pad can facilitate removing the substrate 10 from the polishing pad 32 because air can enter the space between the substrate 10 and the polishing pad 32 by way of the grooves or other topography on the polishing pad 32, preventing the formation of a vacuum. However, when slurry is used to polish the substrate 10, the slurry can fill the grooves or indentations in polishing pad 32, preventing air from passing beneath the substrate. Further, as the polishing pad 32 is frictionally heated, compressed and abrasively worn away, the surface of the polishing pad 32 becomes smoother. The smoother surface of the polishing pad 32 can require more force and/or more time can to pull the substrate 10 from the polishing pad 32. The greater the force applied to the substrate or the longer the substrate is deformed, the greater the likelihood of causing defects in the substrate. By lifting the edges 212 of the substrate 10 from the polishing pad 32, the dechuck method is less dependent on the surface condition of the polishing pad. The edge lift dechuck technique pulls the substrate from the edge, such that a low-pressure or vacuum pocket is not formed between the substrate and the polishing pad.

With the center-lift technique, a low-pressure pocket can create a suction area that seals the substrate 10 to the polishing pad 32. The edge-lift technique avoids creating this seal between the substrate and the polishing pad and reduces the amount of force required to dechuck the substrate 10 from the polishing pad 32. Less force may be required to dechuck the substrate. Accordingly, less stress is placed on the substrate 10 than with the conventional center lift technique, decreasing the likelihood of defects in or breakage of the substrate 10. Further, the edge-lift technique can be faster than other removal techniques and the substrate may thus be placed under stress for less time than with other removal techniques.

A number of embodiments of the invention have been described. Nevertheless, it will be understood that various modifications may be made without departing from the spirit and scope of the invention. For example, the pressurizable chambers can be annular, axial, randomly spaced, evenly spaced, or a combination thereof. There can be as few as two pressurizable chambers or any number of pressurizable chambers greater than two. Accordingly, other embodiments are within the scope of the following claims.

What is claimed is:

1. A method of dechucking a substrate from a surface, comprising:

applying a first pressure to a central portion of a first side of a substrate, wherein a second side of the substrate is in contact with a polishing surface, the first pressure is applied by a fluid pressurized to greater than atmospheric pressure and applying the first pressure applies a pressure toward the polishing surface; and applying a second pressure to the first side at an outer portion of the first side of the substrate, wherein applying the second pressure pulls the outer portion of the substrate away from the polishing surface;

wherein concurrently applying the first and second pressures causes the substrate to move away from the polishing surface.

2. The method of claim 1, wherein applying a second pressure to the first side includes applying an absolute pressure that is less than the absolute pressure of the first pressure.

3. The method of claim 1, wherein the second pressure is less than atmospheric pressure.

4. The method of claim 1, wherein:

applying a second pressure includes applying pressure to art annular zone of the substrate.

5. The method of claim 1, wherein:

applying the first pressure includes removing fluid from an area adjacent to the central portion of the substrate.

6. The method of claim 1, wherein:

applying the first pressure includes introducing fluid into an area adjacent to the central portion of the substrate.

7. The method of claim 1, wherein:

applying the second pressure includes evacuating fluid from an area adjacent to an area surrounding the central portion of the substrate.

8. The method of claim 1, wherein:

applying the second pressure includes evacuating fluid from a chamber between a membrane and a carrier head.

9. The method of claim 1, wherein:

applying the first and second pressures includes applying no more than about twenty pounds across the substrate.

10. The method of claim 9, wherein:

applying the first and second pressures includes applying no more than about ten ponds across the substrate.

11. The method of claim 10, wherein:

applying the first and second pressures includes applying no more than about five pounds across the substrate.

12. A method of dechucking a substrate from a surface, comprising:

applying a first pressure to a central portion of a first side of a substrate, wherein a second side of the substrate is in contact wit a polishing surface; and applying a second pressure to the first side at an outer portion of the first side of the substrate, wherein the second pressure generates a force on the substrate away from the polishing surface;

applying a third pressure on the first side, such that the third pressure places a downward force on the perimeter of the substrate;

wherein applying the first and second pressures causes the substrate to move away from the polishing surface.

13. A method of dechucking a substrate from a surface, comprising:

retaining a substrate within a retaining ring while applying a pressure to at least a portion of a first surface of the substrate at a time when a second surface of the substrate contacts a polishing surface; and causing the pressure applied to the first surface to vary so tat a pressure is applied to a center portion of the substrate and a perimeter portion of the substrate is pulled away from the polishing surface before the center portion of the substrate is pulled from the polishing surface;

wherein causing the pressure applied to the first surface to vary includes creating a fluid pressure adjacent to the first surface at a center of the substrate to be greater than atmospheric pressure.

14. The method of claim 13, wherein:

causing the pressure applied to the first surface includes applying an upward pressure at the perimeter portion of the substrate.

15. The method of claim 14, wherein:

causing the pressure applied to the first surface includes applying a downward pressure at en edge portion of the substrate, wherein the perimeter portion is closer to the center portion of the substrate than the edge portion.

16. The method of claim 13, wherein:

causing the pressure applied to the first surface includes removing the substrate from the polishing surface.

17. The method of claim 13, wherein:

causing the pressure applied to the first surface includes applying a pressure of about twenty pounds or less across the substrate.

18. The method of claim 17, wherein:

causing the pressure applied to the first surface includes applying a pressure of about ten pounds or less across the substrate.

19. The method of claim 18, wherein:

causing the pressure applied to the first surface includes applying a pressure of about five pounds or less across the substrate.

20. A method of dechucking a substrate from a surface, comprising:

contacting a membrane to a back side of a substrate, wherein the membrane has walls forming at least two chambers adjacent to the back side of the substrate and each of the chambers is independently pressurizable from other chambers;

pressurizing a central chamber to greater than atmospheric pressure; and applying a vacuum to a surrounding chamber, wherein the surrounding chanter is adjacent to an outer portion of the substrate;

wherein pressurizing the central chamber and applying a vacuum to a surrounding chamber pulls the substrate away from a surface.

21. The method of claim 20, further comprising pressurizing a chamber adjacent to an edge of the substrate.

* * * * *